United States Patent [19]

Sakamoto et al.

[11] Patent Number: 4,561,396

[45] Date of Patent: Dec. 31, 1985

[54] FUEL CONTROL APPARATUS FOR AN INTERNAL COMBUSTION ENGINE

[75] Inventors: Yoshiyuki Sakamoto; Seiji Wataya, both of Hyogo, Japan

[73] Assignee: Mitsubishi Denki Kabushiki Kaisha, Tokyo, Japan

[21] Appl. No.: 640,249

[22] Filed: Aug. 14, 1984

Related U.S. Application Data

[63] Continuation of Ser. No. 455,636, Jan. 5, 1983, abandoned.

[30] Foreign Application Priority Data

Jan. 14, 1982 [JP] Japan ..... 57-5624

[51] Int. Cl.[4] ..... F02B 77/00; F02M 51/08

[52] U.S. Cl. ..... 123/198 E; 123/478; 123/472; 123/647

[58] Field of Search ..... 123/478, 472, 647, 198 E

[56] References Cited

U.S. PATENT DOCUMENTS

| | | | |
|---|---|---|---|
| 3,395,684 | 8/1968 | Minks | 123/647 |
| 3,996,914 | 12/1976 | Crall et al. | 123/198 E |
| 4,006,724 | 2/1977 | Carter | 123/198 E |
| 4,098,251 | 7/1978 | Scott | 123/198 E |
| 4,198,943 | 4/1980 | Wörz | 123/647 |
| 4,257,376 | 3/1981 | Wen | 123/472 |
| 4,327,675 | 5/1982 | Takeda | 123/472 |
| 4,378,001 | 3/1983 | Takada et al. | 123/472 |
| 4,397,291 | 8/1983 | Johnson | 123/647 |
| 4,402,294 | 9/1983 | McHugh et al. | 123/478 |
| 4,418,673 | 12/1983 | Tominari et al. | 123/478 |

FOREIGN PATENT DOCUMENTS

| | | | |
|---|---|---|---|
| 2225917 | 11/1974 | France | 123/647 |
| 2442974 | 8/1980 | France | 123/647 |
| 0065224 | 5/1979 | Japan | 123/647 |
| 0126833 | 10/1979 | Japan | 123/647 |
| 2000386 | 1/1979 | United Kingdom | 123/647 |

*Primary Examiner*—Raymond A. Nelli

*Attorney, Agent, or Firm*—Sughrue, Mion, Zinn, Macpeak, and Seas

[57] ABSTRACT

A fuel control apparatus for an internal combustion engine which has an air intake tube includes an electrically controlled fuel injection valve and a control device for controlling the valve in accordance with various parameters of the engine. The control device includes a radiating fin which is located on one end surface of the control device for removing heat which is generated by heat-generating elements which drive the valve. The control device is mounted on the air intake tube so that the radiating fin projects into the air intake tube. In this manner, the radiating fin is cooled by incoming air.

4 Claims, 2 Drawing Figures

FUEL CONTROL APPARATUS FOR AN INTERNAL COMBUSTION ENGINE

This application is a continuation of application Ser. No. 455,636, filed Jan. 5, 1983, now abandoned.

BACKGROUND OF THE INVENTION

1. Field of the Invention

This invention relates to a fuel control apparatus for an internal combustion engine and, more particularly, to a fuel control apparatus system for an internal combustion engine which employs an electronically controlled fuel injection device.

2. Description of the Prior Art

FIG. 1 shows a conventional fuel control apparatus for an internal combustion engine of a motor vehicle. An intake tube 1, which is connected to the intake port of the engine, defines a fuel and air mixing chamber 2. The mixing chamber 2 has a fuel control valve 3 for supplying fuel into the chamber 2 and a throttle valve 4, which is disposed downstream of the valve 3, for controlling the flow rate of a fuel-air mixture. The fuel control valve 3 is electrically connected to a control device 5. The control device 5 is also electrically connected to a sensor, which is provided in the intake tube 1 and located upstream of the fuel control valve 3, for detecting the quantity of the air coming into the intake tube (for example, an air sensor 6 of the hot wire type), and a water temperature sensor 8 is located on the body of the engine 7 for detecting the temperature of water in a cooling jacket. An air cleaner 9 is provided at the inlet of the intake tube 1.

According to the apparatus described above, an optimum quantity of fuel is calculated in the control device 5 in accordance with the quantity of incoming air and the engine temperature determined by the air sensor 6 and the water temperature sensor 8, respectively. A drive signal is then transmitted to the fuel control valve 3 in accordance with the results of the above calculation to control the flow rate of the fuel which is supplied through the valve 3. According to this conventional arrangement, however, the control device 5 is mounted in a vehicle compartment away from the engine since the control device utilizes electronic parts which cannot be heated above a predetermined temperature. Accordingly, it has been difficult to mount the control device in an engine compartment in which high temperatures prevail. The installation of the control device 5 in a vehicle compartment which is displaced from the intake passage 2, as well as from the engine, requires a great deal of wire. In addition, such an installation also requires a great deal of time and labor to complete the electrical wiring since the control device is spaced a considerable distance from the fuel control valve 3, the air sensor 6 in the mixing chamber 2, and the water temperature sensor 8 on the engine. The installation of the device 5 in a vehicle compartment which is spaced away from the engine is further disadvantageous in that the associated electrical wiring is sometimes influenced by noise which is transmitted from the wiring of other instruments in the vehicle.

If the control device 5 is spaced apart a long distance from the fuel control valve 3, the air sensor 6 and the water temperature sensor 8, it is difficult to make the necessary adjustments for improving the accuracy of the entire control system on the motor vehicle. Accordingly, the fuel control valve 3, the control device 5 and the air sensor 6 must be designed with a high degree of accuracy and are, therefore, expensive. The conventional apparatus also requires a large radiating member for cooling the circuits of the various sections of the control device 5 (for example, a switching element and a power source circuit for driving the fuel control valve 3), as they are likely to generate a great deal of heat.

SUMMARY OF THE INVENTION

It is, therefore, an object of the present invention to provide a control system for an internal combustion engine which employs an electronically controlled fuel injection device so that the control system includes a fuel control apparatus which can adjust for any deviation in the operation of the control system as a whole to improve its overall control accuracy and which also dissipates the heat generated in the control device.

In accordance with the present invention, a fuel control apparatus for an internal combustion engine, which has an intake tube, comprises an electrically controlled fuel injection valve and a control device for controlling the fuel injection valve in accordance with various parameters of the engine. The control device includes a radiating fin which is located on one end surface of the control device for removing heat from heat-generating elements which drive the valve. The control apparatus further includes a mount for the control device on the air intake tube so that the radiating fin is cooled by incoming air.

DESCRIPTION OF THE PREFERRED EMBODIMENTS

Figure 1:
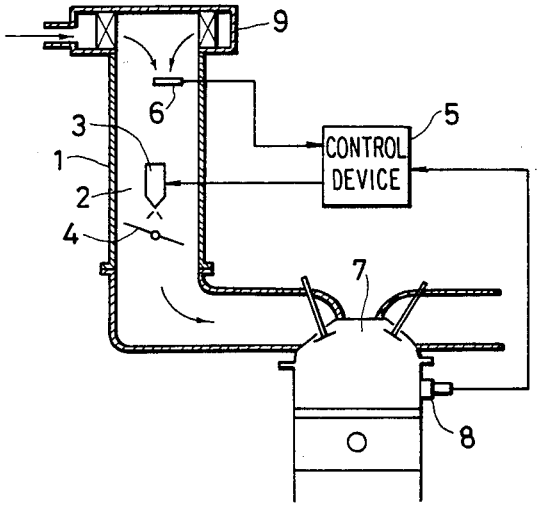
FIG. 1 PRIOR ART
FIG. 1 is a schematic representation, partly in section, of a conventional fuel control apparatus for an internal combustion engine.
Figure 2:
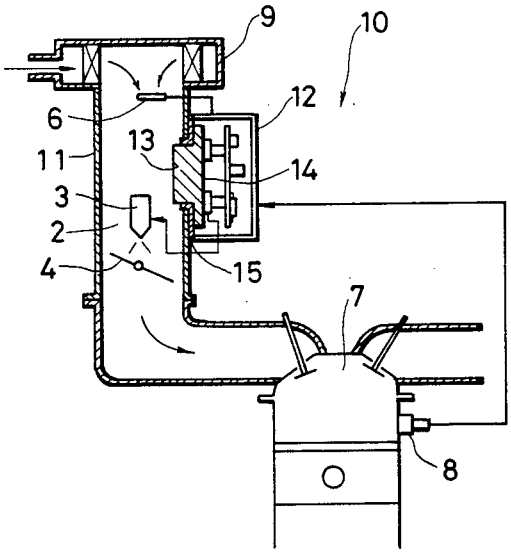
FIG. 2 is a schematic representation, partly in section, of a fuel control apparatus for an internal combustion engine which is constructed in accordance with the present invention.

An embodiment of a fuel control apparatus for an internal combustion engine which is constructed according to the present invention is shown in FIG. 2. In FIG. 2, elements which are identical to elements shown in FIG. 1 are identified with like reference numerals.

The fuel control apparatus 10 of the present invention includes an electrically controlled fuel injection or control valve 3 which is located in a fuel and air mixing chamber 2. The mixing chamber 2 is defined by an intake tube 11 for an internal combustion engine. A control device 12 is mounted on the outer wall of the intake tube 11 within which the mixing chamber 2 is defined. The control device 12 has a radiator 14 including a radiating fin 13 which projects outwardly from one side of the device. The radiator 14 carries circuit components on it which dissipate a large amount of power, for example, a switching element and a power source circuit for driving the fuel control valve 3.

The intake tube 11 has an opening in its sidewall, and the radiating fin 13 is fitted into that opening and projects into the intake tube. A heat insulating material 15 is disposed between one end surface of the control device 12 and the sidewall of the intake tube 11 and is maintained in intimate contact with these elements. As readily can be seen, according to the present invention, the control device 12 is positioned closely adjacent to the mixing chamber 2 in which the fuel control valve 3 is disposed. Accordingly, the measurement of the desired quantity of incoming air, which is the most important factor for calculating the quantity of fuel to be supplied, the calculation of the quantity of fuel to be supplied, and the metering of fuel are all accomplished at the same location. The installation in close proximity to one another of all of the principal components, of which a high accuracy of performance is required, facilitates the accurate control of the entire control system, as opposed to the conventional arrangement of FIG. 1 in which the control device 5, the fuel control valve 3 and the air sensor 6 are spaced apart from each other in the vehicle compartment and in the intake tube for the engine 7.

Means are provided in the control device 12 for correcting any and all errors which occur in the fabrication of the fuel control valve 3 and the air sensor 6 in order to improve the accuracy of the entire system. The apparatus of this invention is inexpensive, reliable and easy to install in a motor vehicle since its principal components are positioned in close proximity to one another and do not require much electrical wiring. The radiating fin 13, which absorbs heat from the switching element which is provided in the control device 12 for driving the fuel control valve 3 and from the power source circuit supplying a stabilized voltage to the internal circuit of the control device, can be small since the radiating fin 13 is positively cooled by the incoming air. Even if the heat load of the switching element is increased with an increase in the load of the engine, a small radiating fin can continue to provide an effective cooling action since it is cooled by the air flowing into the intake tube at an increased flow rate.

It is important to maintain the control device 12 at a relatively low ambient temperature since it is mainly composed of semiconductors. This requirement is met by the heat insulating material 15 which is disposed between the intake tube 11 and the control device 12. The insulating material 15 substantially protects the control device from the influence of any intense heat which may be generated by the engine.

In the embodiment described above, although the fuel control valve 3 is provided upstream of the throttle valve 4, it is equally possible to position the fuel control valve 3 downstream of the throttle valve 4. It is also possible to provide a fuel control valve 3 for each cylinder of the engine 7. This alternative arrangement does not affect the cooling effect provided by the radiating fin 13 for the control device 12.

As is obvious from the foregoing description, it is possible to adjust for errors in the fabrication and operation of the various components in a control system for an internal combustion engine which employs an electrically controlled fuel injection device, thereby improving the control accuracy of the entire system because the control device is mounted on the intake tube in close proximity to the air sensor and the fuel control valve. It is sufficient to employ a small radiating fin for the control device because the fin is positively cooled by the incoming air which absorbs heat from the heat-generating components of the control device.

We claim:

1. A fuel control apparatus for an internal combustion engine having an air intake tube rigidly attached to said air intake tube providing fluid communication between an air cleaner and said engine and having disposed therein a throttle valve, comprising:

an electrically controlled fuel injection valve;

a control device for controlling said fuel injection valve in accordance with various parameters of said engine, said control device including a radiating fin on one end surface of said control device for removing heat from heat-generating elements which drive said fuel injection valve; and means for mounting said control device on said air intake tube to directly fix said control device on said intake tube between said air cleaner and said engine, so that said radiating fin is cooled by incoming air conveyed in said air intake tube.

2. The apparatus as claimed in claim 1 wherein said air intake tube has an opening in a side wall thereof around which said control device is mounted so that said radiating fin projects into said air intake tube through said opening.

3. The apparatus as claimed in claim 2 wherein said radiating fin is fixed to a radiator located within said control device, said radiator having said heat-generating elements connected thereto, said heat-generating elements including a switching element and a power source circuit.

4. The apparatus as claimed in claim 3 further comprising a heat insulating material disposed between one end surface of said control device and said side wall of said intake tube.

* * * * *